US005665501A

United States Patent [19]

Derks et al.

[11] Patent Number: 5,665,501

[45] Date of Patent: Sep. 9, 1997

[54] PHOTOCONDUCTIVE ELEMENT WITH POLYCARBONATE BINDER

[75] Inventors: Petrus J. M. Derks, Velden; Hendrik J. A. Ogrinc, Venlo, both of Netherlands

[73] Assignee: Oce-Nederland, B.V., Venlo, Netherlands

[21] Appl. No.: 740,690

[22] Filed: Nov. 1, 1996

[30] Foreign Application Priority Data

Nov. 9, 1995 [NL] Netherlands ..... 1001611

[51] Int. Cl.[6] ..... G03G 5/06; G03G 5/047

[52] U.S. Cl. ..... 430/59; 430/58; 430/96

[58] Field of Search ..... 430/58, 59, 96

[56] References Cited

U.S. PATENT DOCUMENTS

| | | | |
|---|---|---|---|
| 2,999,750 | 9/1961 | Miller et al. | 430/96 |
| 4,543,310 | 9/1985 | Everhardus et al. | 430/59 |
| 4,956,256 | 9/1990 | Ohtsuka et al. | 430/58 |
| 4,968,573 | 11/1990 | Kaneko et al. | 430/106.6 |
| 5,130,215 | 7/1992 | Adley et al. | 430/58 |
| 5,576,162 | 11/1996 | Papadopoulos | 430/56 |

FOREIGN PATENT DOCUMENTS

| | | | |
|---|---|---|---|
| 63-136051 | 6/1986 | Japan | 430/96 |
| 63-065444 | 3/1988 | Japan | 430/96 |
| 834502 | 5/1960 | United Kingdom . | |

*Primary Examiner*—Roland Martin

*Attorney, Agent, or Firm*—Birch, Stewart, Kolasch & Birch, LLP

[57] ABSTRACT

A photoconductive element having a photoconductive layer containing a polycarbonate binder based on di-(monohydroxyaryl) alkane, wherein the polycarbonate contains a branching agent selected from the group consisting of 1,2,4-benzene tricarboxylic acid, 1,3,5-benzene tricarboxylic acid, 1,2,4-benzene tricarboxylic acid chloride and 1,3,5-benzene tricarboxylic acid chloride.

13 Claims, No Drawings

PHOTOCONDUCTIVE ELEMENT WITH POLYCARBONATE BINDER

The present invention relates to a photoconductive element having a photoconductive layer containing a polycarbonate binder based on a di-(monohydroxyaryl) alkane.

Photoconductive elements of this kind are mentioned, for example, in GB-A-0 834 502. In practice, there are problems in connection with the production of such photoconductive elements having the above binder. For example, a linear polycarbonate based on bisphenol A, such as Lexan 141™, can be satisfactorily dissolved only in halogenated solvents, such as, for example, dichloromethane.

In addition, binder solutions and preparations for the photoconductive layers are not stable. Gelation occurs after a short time.

Crystallization of the binders can also occur, resulting in matt layers. To avoid this matt effect, the photoconductive element coating process requires extra attention.

Other extreme influences can also affect the quality and stability of the photoconductive element. Thus, it has been found that stress corrosion can occur if the photoconductive element comes into contact with skin scale (such as dandruff) and skin grease and oils.

The object of the invention is to reduce or eliminate the above-described problems. To this end, according to the invention, the polycarbonate contains a branching agent selected from the group consisting of 1,2,4-benzene tricarboxylic acid, 1,2,4-benzene tricarboxylic acid, 1,3,5-benzene tricarboxylic acid chloride and 1,3,5-benzene tricarboxylic acid chloride.

Polycarbonate binders of this kind are satisfactorily soluble in halogen-free solvents such as tetrahydrofuran. Waste problems are avoided as much as possible by avoiding halogen-containing chemicals in the production process. Preferably, between 0.1 mol-% and 1 mol-% of branching agent and particularly preferably between 0.1 mol-% and 0.5 mol-% of branching agent are used. This has practically no influence on the cost of production. The binder solutions and preparations are also much more stable than those of the prior art.

A particularly favorable polycarbonate has been found to be one based on 4,4'-dihydroxydiphenyl propane with a branching agent. Even after a standing time of more than 4 months, no gelation occurs, so that the photoconductive element production process becomes more reliable and economical. The production yield is significantly increased. Matting, i.e., partial crystallization of the binder resulting in limited storage stability, hardly occurs, if at all. It has also been found advantageous to use the branched polycarbonate in combination with a plasticizer. This greatly increases resistance to stress corrosion. The addition of dioctyl phthalate has been found particularly advantageous in this connection.

A branched polycarbonate based on 4,4-dihydroxydiphenyl propane with a branching agent in the presence of dioctyl phthalate in which an azine according to EP-0 085 447 has been mixed as a transport substance is more than three times as insensitive to stress corrosion than a linear polycarbonate based on 4,4-dihydroxydiphenyl propane and dioctyl phthalate.

The photoconductive element can be in the form of a single layer system in which a layer contains both one or more charge-generating pigments and at least one or more transport substances. It is also possible to use multi-layer photoconductive elements provided with a generating layer and a transport layer, wherein at least one of said layers is provided with the binder according to the invention. The photoconductive element according to the invention can be produced in ways known to those skilled in the art.

For this purpose, a substrate is provided with a photoconductive layer which can contain one or more layers as described above. The substrate may contain an organic layer such as Mylar (du Pont™) or Melinex (ICI™) (polyethylene terephthalate) or another polymer substrate suitable for the purpose, a semi-conductive layer or a conductive layer, such as aluminum, chromium, nickel, etc.

If necessary, the polymer substrate can be rendered conductive by the application of a thin metal layer. The invention is particularly suitable for indirect electrophotography in the form of an endless photoconductive element having as substrate a metal roller or a flexible endless band of paper or plastic in a multi-layer photoconductor. The generating layer may be the known charge-generating compounds mixed or otherwise contained in the binder according to the invention. In particular, very good results are obtained with perylene pigments vapor-coated on the substrate. The transport substances known in the art can be used in the binder according to the invention in the transport layer of the multi-layer photoconductive element. Very favorable results with regard to stability of the transport layer preparation in respect of insensitivity to skin scale and skin grease are obtained in combination with azines according to EP 0085447, para-tri-tolyl amine and hydrazones. In the case of these latter transport substances, a mixture is preferably used of

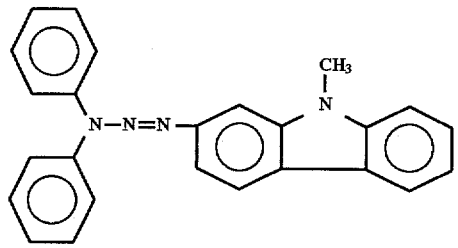

and

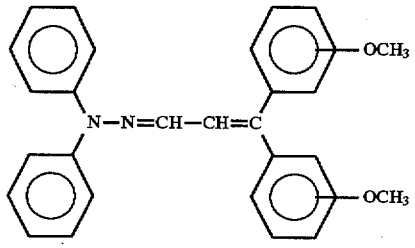

The invention will now be explained in detail with reference to a number of examples, but the invention is not limited thereto.

EXAMPLE 1

A transport layer was prepared with a branched polycarbonate prepared in a manner known in the art from 4,4'- dihydroxyphenyl propane (bisphenol A), phosgene and a small quantity (0.3 mol-%) of 1,2,4-benzene tricarboxylic acid chloride. For this purpose, 45.2 g of polycarbonate binder was dissolved in 927 g of tetrahydrofuran together with 27.1 g of transport substance having the following molecular formula:

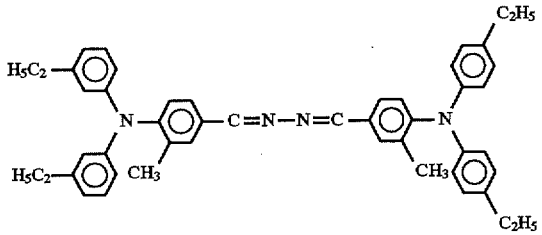

This preparation did not exhibit any gelation even after 4 months of storage. The preparation is applied to an aluminum cylinder provided with a vapor-coated generating layer, in which the generating pigment used is a perylene pigment according to the molecular formula:

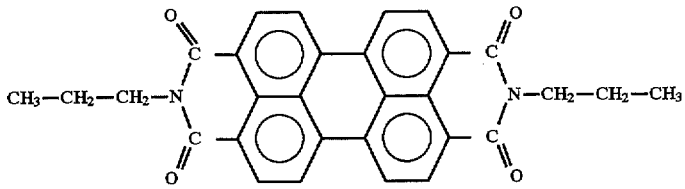

A light-yellow non-cracking and non-matt transport layer is obtained after drying.

The photoelectric properties of the photoconductor are practically identical to the photoelectric properties of the photoconductor prepared according to Example 2

EXAMPLE 2

A transport layer preparation with a linear polycarbonate binder was prepared in the same way as described in Example 1. The polycarbonate binder was prepared in a known manner from 4,4'-dihydroxyphenyl propane and phosgene. After less than a month of storage, this preparation already exhibits gelation. A transport layer of this preparation applied to an aluminum cylinder provided with a generating layer according to Example 1 often exhibits matting. The production yield drops considerably.

EXAMPLE 3

5% by weight of dioctyl phthalate was mixed into the transport layer preparation according to Example 1. No gelation occurred. The transport layers made with this preparation are sufficiently resistant to cracking.

EXAMPLE 4

5% by weight of dioctyl phthalate was mixed into the transport layer preparation according to Example 2.

Gelation occurred after about 1 month and the solution could no longer be filtered.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A photoconductive element having a photoconductive layer containing a polycarbonate binder based on di-(monohydroxyaryl) alkane, wherein the polycarbonate contains a branching agent selected from the group consisting of 1,2,4-benzene tricarboxylic acid, 1,3,5-benzene tricarboxylic acid, 1,2,4-benzene tricarboxylic acid chloride and 1,3,5-benzene tricarboxylic acid chloride.

2. A photoconductive element according to claim 1, wherein the amount of branching agent in the binder is from 0.1 mol-% to 1 mol-%.

3. A photoconductive element according to claim 2, wherein the amount of branching agent in the binder is from 0.1 mol-% to 0.5 mol-%.

4. A photoconductive element according to any one of claims 1 to 3, wherein a plasticizer is included in the binder solution.

5. A photoconductive element according to claim 4, wherein the plasticizer is dioctyl phthalate.

6. A photoconductive element having a photoconductive layer with a generating layer and a transport layer, the latter containing a polycarbonate binder based on di-(monohydroxyaryl) alkane, wherein the polycarbonate contains a branching agent selected from the group consisting of 1,2,4-benzene tricarboxylic acid, 1,3,5-benzene tricarboxylic acid chloride, 1,2,4-benzene tricarboxylic acid chloride and 1,3,5-benzene tricarboxylic acid chloride.

7. A photoconductive element according to claim 6, wherein the amount of branching agent in the binder is from 0.1 mol-% to 1 mol-%.

8. A photoconductive element according to claim 7, wherein the amount of branching agent in the binder is from 0.1 mol-% to 0.5 mol-%.

9. A photoconductive element according to any one of claims 6 to 8, wherein a plasticizer is included in the binder solution.

10. A photoconductive element according to claim 9, wherein the plasticizer is dioctyl phthalate.

11. A photoconductive element according to claim 6, wherein an azine transport substance having the following molecular formula is mixed in the transport layer:

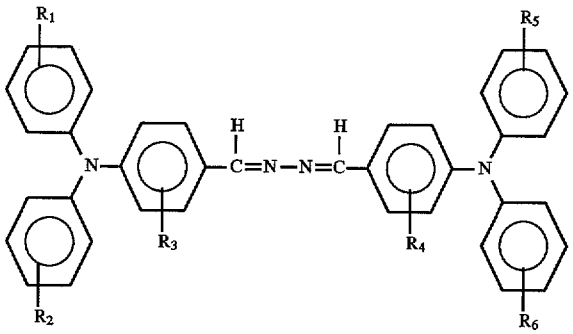

where $R_1$–$R_6$ comprise a hydrogen atom or an alkyl group with 1–4 carbon atoms.

12. A photoconductive element according to claim 6, wherein para-tri-tolyl amine is included as a transport substance in the transport layer.

13. A photoconductive element according to claim 6, wherein a mixture of hydrazones having the following molecular formulae is included in the transport layer:

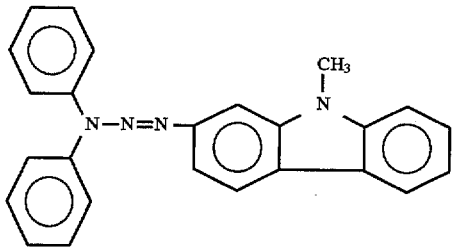

and

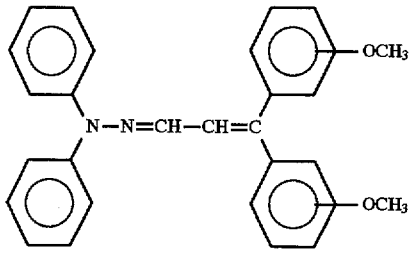

* * * * *